US008671854B2

(12) United States Patent
Cole et al.

(10) Patent No.: US 8,671,854 B2
(45) Date of Patent: Mar. 18, 2014

(54) SHAFT SEAL FOR PYROLYTIC WASTE TREATMENT SYSTEM

(75) Inventors: Cameron Cole, Rainbow, CA (US); Raul de la Torres, Bell Gardens, CA (US); Toby L. Cole, Temecula, CA (US); Dan Watts, Surfside, CA (US)

(73) Assignee: APS IP Holding LLC

( * ) Notice: Subject to any disclaimer, the term of this patent is extended or adjusted under 35 U.S.C. 154(b) by 0 days.

(21) Appl. No.: 12/422,150

(22) Filed: Apr. 10, 2009

(65) Prior Publication Data

US 2009/0308294 A1 Dec. 17, 2009

Related U.S. Application Data

(63) Continuation of application No. 11/613,341, filed on Dec. 20, 2006, now abandoned, which is a continuation of application No. 10/923,139, filed on Aug. 19, 2004, now Pat. No. 7,191,714.

(60) Provisional application No. 60/497,397, filed on Aug. 21, 2003.

(51) Int. Cl.
*F23G 5/027* (2006.01)
*F27D 3/08* (2006.01)

(52) U.S. Cl.
USPC ..... 110/229; 432/244; 110/286

(58) Field of Classification Search
USPC ..... 110/229, 230, 286; 432/244; 277/500, 277/510, 511, 520, 523, 524, 525, 526, 551
See application file for complete search history.

(56) References Cited

U.S. PATENT DOCUMENTS

| | | | | | |
|---|---|---|---|---|---|
| 2,371,166 | A * | 3/1945 | Harcourt | 277/510 |
| 3,428,375 | A * | 2/1969 | Martin | 384/482 |
| 4,338,868 | A | 7/1982 | Lientz | |
| 4,545,764 | A * | 10/1985 | Gillies et al. | 432/115 |
| 4,589,354 | A | 5/1986 | Faehnle | |
| 4,759,300 | A | 7/1988 | Hansen et al. | |
| 4,765,255 | A | 8/1988 | Chiarva | |
| 5,242,245 | A | 9/1993 | Schellstede | |
| 5,653,183 | A | 8/1997 | Hansen et al. | |
| 5,868,085 | A | 2/1999 | Hansen et al. | |
| 6,221,329 | B1 * | 4/2001 | Faulkner et al. | 110/267 |
| 6,619,214 | B2 | 9/2003 | Walker | |
| 6,901,868 | B2 * | 6/2005 | Hornung et al. | 110/246 |

* cited by examiner

*Primary Examiner* — Kenneth Rinehart
*Assistant Examiner* — David J Laux
(74) *Attorney, Agent, or Firm* — Stetina Brunda Garred & Brucker

(57) ABSTRACT

The inventive subject matter is directed toward a pyrolytic waste treatment system comprising a pyrolysis chamber having a chamber wall with a hole through which a shaft passes. An insulating mechanism is used at the hole to inhibit heat from escaping through the opening in the chamber wall.

10 Claims, 2 Drawing Sheets

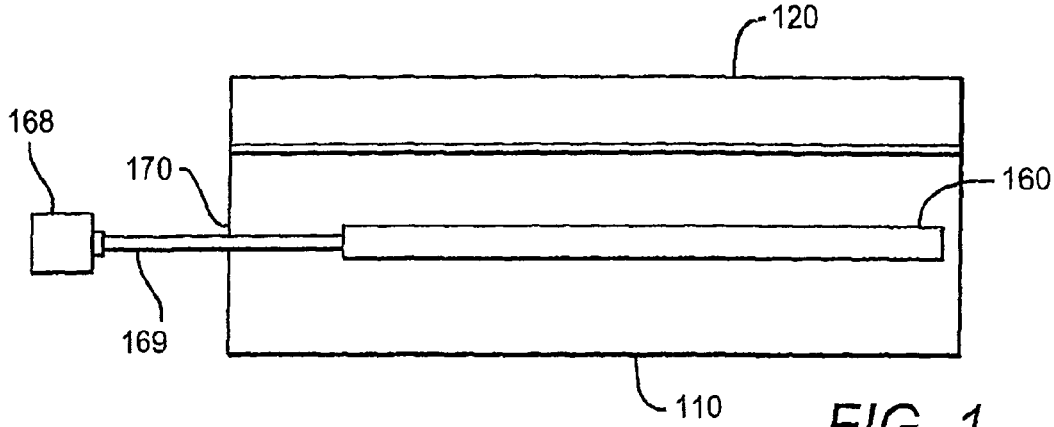
FIG. 1
FIG. 2b
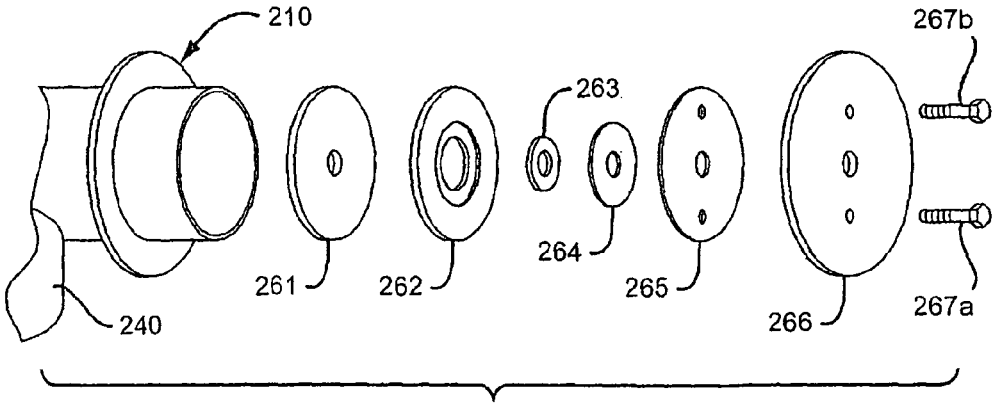

SHAFT SEAL FOR PYROLYTIC WASTE TREATMENT SYSTEM

This application is a continuation of U.S. application Ser. No. 11/613,341, filed Dec. 20, 2006, which is a continuation of U.S. application Ser. No. 10/923,139, filed Aug. 19, 2004, which claims the benefit of U.S. provisional application No. 60/497,397 filed on Aug. 21, 2003. These and all other extraneous materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is pyrolytic waste treatment.

BACKGROUND OF THE INVENTION

Pyrolysis is a known method for treatment of waste. Examples of pyrolytic waste treatment systems can be found in U.S. Pat. Nos. 4,759,300, 5,653,183, 5,868,085, and 6,619,214. Unlike incineration, pyrolysis is the destructive decomposition of waste materials using indirect heat in the absence of oxygen. Burning waste through incineration with direct flame in the presence of oxygen can be explosive, causing turbulence in the burning chamber, which fosters a recombination of released gases. Waste destruction in an oxygen-rich atmosphere makes conversion far less complete, is highly inefficient and creates harmful substances.

In contrast, the pyrolytic process employs high temperature in, most desirably, an atmosphere substantially free of oxygen (for example, in a practical vacuum), to convert the solid components of waste to a mixture of solids, liquids, and gases with proportions determined by operating temperature, pressure, oxygen content, and other conditions. The solid residue remaining after pyrolysis commonly is referred to as char. The vaporized product of pyrolysis is often further treated by a process promoting oxidation, which "cleans" the vapors to eliminate oils and other particulate matter there from, allowing the resultant gases then to be safely released to the atmosphere.

What has long been needed and heretofore has been unavailable is an improved pyrolytic waste treatment system that is highly efficient, is easy to maintain, is safe, reliable and capable of operation with a wide variety of compositions of waste materials, and that can be constructed and installed at relatively low cost. The thrust of the present invention is to provide such an improved pyrolytic waste treatment system.

SUMMARY OF THE INVENTION

The present subject matter is directed toward a pyrolytic waste treatment system having a shaft that passes through an opening in a wall of the waste treatment chamber. The system has an insulating mechanism adapted to inhibit heat from escaping through the opening in the chamber wall while permitting the shaft to translate as well as rotate at the point where the shaft passes through the opening.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 1 is a schematic of a pyrolytic waste treatment system.

FIG. 2*b* is an exploded view of a seal assembly.

DETAILED DESCRIPTION

Figure 2A:
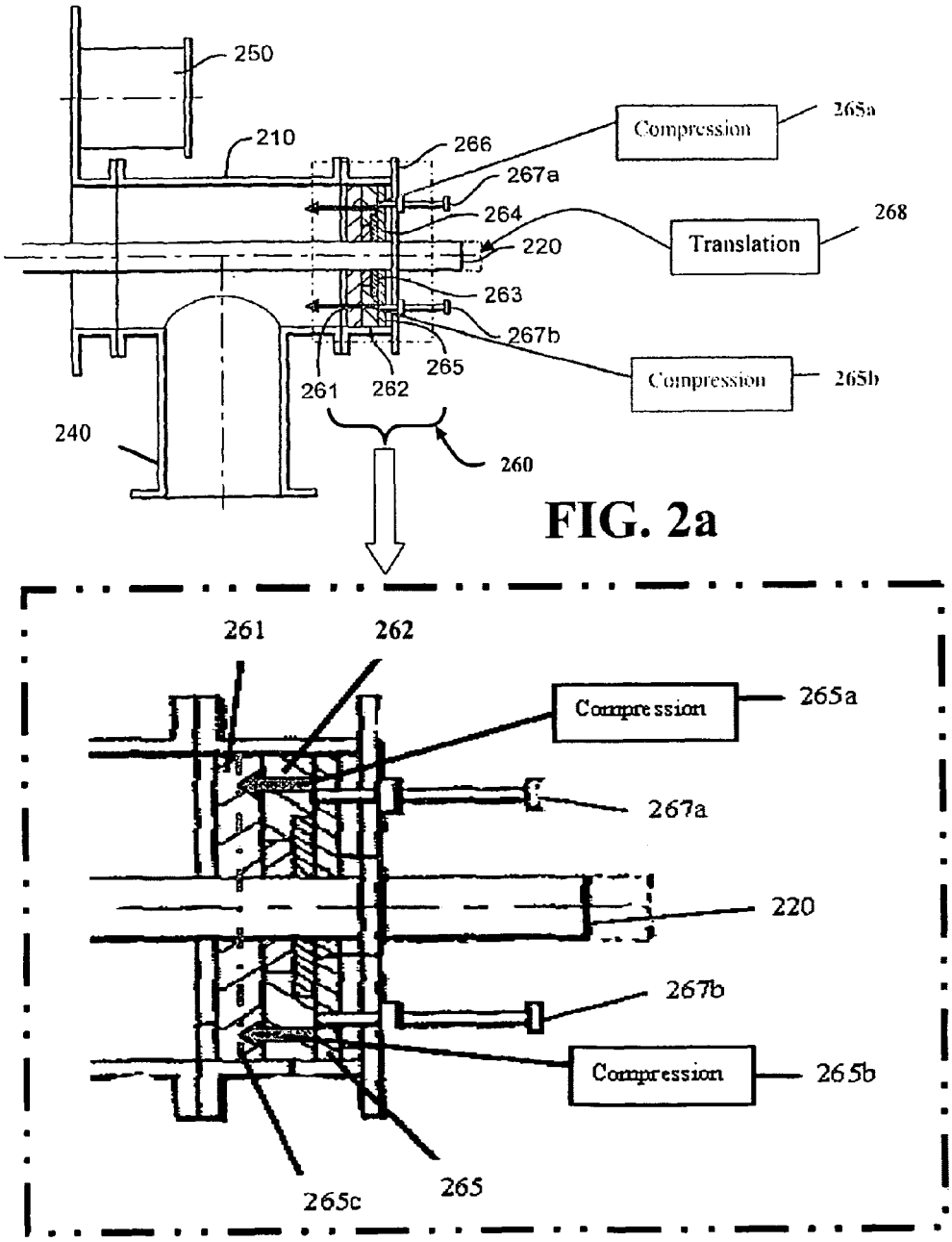
FIG. 2*a* is a schematic of an alternate pyrolytic waste treatment system.

FIG. 1 comprises a pyrolytic waste treatment system generally comprising a waste treatment chamber 110 and a heating chamber 120.

The shaft 169 of mechanism 160 is rotated by a hydraulic motor 168 which is positioned outside the pyrolysis chamber 110 and the heating chamber 120 due to the high temperatures inside the chambers. As such, the shaft 169 will have to penetrate the walls of chamber 110. In many instances the shaft will do so at both ends of the chamber.

For pyrolysis systems that utilize a rotating shaft that enters a pyrolysis chamber it is contemplated that employing a mechanism that permits the shaft to move at its point of entry while remaining sealed would prove advantageous. It has been observed that heating of the shaft tends to cause it to flex and otherwise move relative to its centerline when unheated. This movement tends to cause wear on the shaft and/or seals.

It is contemplated that causing a shaft to pass through a hole in a deformable thermal insulator has proved beneficial in that movement of the shaft tends to compress a portion of the insulator while stretching an opposite portion. The ability of the insulator to both compress and deform, and the fact that the insulator is a single piece surrounding the shaft such that movement of the shaft causes such compression and deformation, reduces the likelihood that movement of the shaft will leave an air gap between the shaft and a portion of the insulator. Since movement is less likely to create air gaps, greater movement of the shaft can be permitted and as a result, the shaft can be more loosely mounted than it would be with other types of insulators. Loosely mounting the shaft in turn is likely to result in less wear on the shaft as it will exert less pressure on any shaft supports if such supports either move with the shaft or permit the shaft to move.

Further improvement can be had by mounting a seal around the shaft where the seal remains fixed relative to the shaft, but otherwise moves in response to shaft movement. It is contemplated that surrounding the seal with the insulator where movement of the seal relative to the insulator is permitted provides the same benefits as described for surrounding the shaft with such an insulator. In preferred embodiments, one or more insulators will surround both a seal which in turn encircles the shaft, and an unsealed portion of the shaft.

Referring to FIGS. 2*a* and 2*b*, a pyrolysis chamber 210 has a char outlet 240 and a vapor/gas outlet 250. Shaft 220 passes through a wall of chamber 210 where the entry point is sealed by seal assembly 260. Seal assembly 260 comprises two toroidal shaped resilient compressible insulating blankets 261 and 262, a seal 263 and plates 264, 265, and 266. Bolts/screws 267 pass through plate 266 and into plate 265 and are adapted to compress blankets 261 and 262 (the compression of blankets 261 and 262, is shown by arrows 265*a* and 265*b* in FIG. 2*a*, labeled as compression). Seal 263 is used to prevent leakage along shaft 220 and has an opening sized and shaped to conform to shaft 220, and an external diameter that is at least approximately equal to the diameter of the central opening in blanket 262. The opening in blanket 261 is sized and shaped to conform to shaft 220 as well.

In seal assembly 260, blankets 261 and 262 are an insulating mechanism adapted to inhibit heat from escaping through the opening in the chamber while permitting the shaft 220 to translate 268 as well as rotate where it passes through the opening. Seal 263 is a sealing mechanism adapted to inhibit air from entering the chamber while permitting the shaft to translate 268 as well as rotate where it passes through the opening. As shown, blankets 261 and 262 surround a portion of the shaft and also surround a portion of the sealing mechanism, and are compressed between plates substantially perpendicular a centerline of the shaft. As blankets 261 and 262 are compressible yet resilient, and have openings sized to fit around the shaft and seal, translation 268 of the shaft results in a corresponding translation of the holes in the blankets and the seal.

Thus, specific embodiments and applications of a pyrolytic system have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A pyrolytic waste treatment system, comprising:

a pyrolysis chamber;

a shaft having a long, axis, and a portion that passes through, and rotates relative to, an opening in a wall of the pyrolysis chamber, and wherein the shaft has at least one of screw flights and paddles, extending radially outwards from the shaft within the chamber;

a seal disposed to seal the opening, and to move in response to shaft movement, the seal being configured to entirely translate with longitudinal translation of the shaft with the seal being flat across an entirety of the seal;

a first resilient insulating blanket surrounding the shaft and disposed to inhibit heat from escaping through the opening, wherein the first insulating blanket couples with the seal, the first resilient insulating blanket being flat across an entirety of the blanket in an undeformed state and disposed in a plane orthogonal to the long axis of the shaft, the first resilient insulating blanket being configured to deform with a radially interior portion of the first resilient insulating, blanket translating along a longitudinal axis of the shaft with the seal upon longitudinal translation of the shaft; and a compression device that compresses the first insulating blanket against the seal.

2. The system of claim 1, wherein the compression device comprises a first plate and a plurality of bolts.

3. The system of claim 2, wherein the compression device further comprises a second plate.

4. The system of claim 1, further comprising a second resilient insulating blanket, which is also positioned to be compressed by the compression device along the long axis of the rotating shaft.

5. The system of claim 1, wherein the first resilient insulating blanket is adjacent to the seal.

6. The system of claim 4, wherein the first insulating blanket is adjacent to the second insulating blanket.

7. The system of claim 2, wherein the first plate couples with the first insulating blanket.

8. The system of claim 3, wherein the second plate is adjacent to the first insulating blanket.

9. The system of claim 1, wherein the seal and first insulating blanket cooperate to seal the shaft against the wall of the pyrolysis chamber.

10. The system of claim 1, wherein the seal has a smaller diameter than the first insulating blanket.

* * * * *